United States Patent [19]

Fowler

[11] Patent Number: 4,689,523

[45] Date of Patent: Aug. 25, 1987

[54] OPTICAL CLEANING SYSTEM FOR REMOVING MATTER FROM UNDERWATER SURFACES

[76] Inventor: Michael P. Fowler, 806 S. Country Club Dr., LaPorte, Tex. 77571

[21] Appl. No.: 698,554

[22] Filed: Feb. 6, 1985

[51] Int. Cl.[4] ..... H05B 37/00

[52] U.S. Cl. ..... 315/76; 134/1; 250/504 R; 315/241 R; 315/241 S

[58] Field of Search ..... 315/32, 33, 76, 108–110, 315/363, 241 R, 241 S; 250/365 UV, 504 R; 219/220; 134/1

[56] References Cited

U.S. PATENT DOCUMENTS

| | | | |
|---|---|---|---|
| 2,095,502 | 10/1937 | Johnston | 134/1 |
| 2,221,318 | 11/1940 | Worthing et al. | 134/1 |
| 2,615,120 | 10/1952 | Macksoud | 250/504 |
| 2,872,622 | 2/1959 | Edgerton | 315/241 R |
| 2,939,984 | 6/1960 | Edgerton | 315/241 R |
| 3,651,366 | 3/1972 | Giannini | 315/241 |
| 4,101,424 | 7/1978 | Schooley | 250/504 |
| 4,368,080 | 1/1983 | Langen | 134/1 |
| 4,444,146 | 4/1984 | DeWitz | 134/1 |

*Primary Examiner*—Harold Dixon

*Attorney, Agent, or Firm*—Dula, Shields & Egbert

[57] ABSTRACT

An optical cleaning system for removing matter from underwater surfaces comprising the high energy strobe lamp, a capacitor electrically connected to the strobe lamp, a power supply electrically connected to the capacitor, and a trigger circuit electrically interactive with the capacitor. The strobe lamp is either a xenon or krypton lamp. Stainless steel reflectors are arranged about the strobe lamp so as to reflect and direct light. The power supply is a generator having a capacity of less than 5 kilovolts. The optical cleaning system may further comprise a cooling fluid and a cooling fluid circulation system in heat exchange relationship with the strobe lamp. The trigger circuit is a transformer electrically connected in series with the capacitor and a switch for actuating the transformer. The optical cleaning system further includes a remotely controlled manipulator arm for positioning the strobe lamp in position about the area to be cleaned.

19 Claims, 9 Drawing Figures

OPTICAL CLEANING SYSTEM FOR REMOVING MATTER FROM UNDERWATER SURFACES

TECHNICAL FIELD

The present invention relates to optical cleaning systems. More particularly, the present invention relates to optical cleaning systems that utilize high intensity photon beams, over narrow band widths, to remove encrustations and other materials from underwater surfaces. Also, the present invention relates to apparatus and methods for cleaning underwater surfaces.

BACKGROUND ART

In recent years, there has been a mammoth increase in the amount of offshore oil and gas exploration, and in other uses of offshore areas. Wells have been drilled in both coastal waters and in the open seas. As the need for oil becomes ever increasing, there is likely to be a vast expansion of exploration and development activities in these offshore areas. In nearly all cases, such exploration and development requires the use of subsea structures and facilities. In relatively shallow waters (less than 200 feet), the oil wells are usually drilled from platforms that rest on the bottom; the drilling platform is constructed above the highest expected waves. In deeper waters and for exploratory work, drilling is done from a floating vessel that is kept in place by a combination of anchors and motors. The building of these offshore platforms and subsea structures requires a great amount of welding and structural integrity. In order to insure such structural integrity and weld acceptability, it is necessary to continually carry out defect and flaw inspection in these subsea structures. As it exists now, visual inspection is one of the most effective way of determining whether the welds and structures have satisfactory integrity. Other techniques are also employed to inspect these subsea surfaces. These techniques may include acoustics, x-rays, and magnetic particle inspection. Unfortunately, the ability to carry out these subsea inspections is hampered, both physically and economically, by the buildup of soft and hard marine growth and accretions.

Over time, any subsea structure will develop a large amount of such growth. These growths can include algaes, sponges, and calciferrous marine growths (e.g., barnacles, corals, and incrustations). Accretions are caused by naturally occurring electrolysis in deep sea. These can be likened to solid mineral deposits caused by electroplating. In all cases, these growths must be removed in order to carry out effective defect and flaw inspections.

In the past, this cleaning was carried out by using grit blasters and water blasters. Grit blasters are a type of underwater sand blaster. The water blasters shoot a stream of water at the marine growth buildup at between 10,000 and 30,000 p.s.i. The cost of using either of these aforestated techniques is extremely expensive. In addition to being expensive, grit blasters and water blasters many times fail to effectively remove the marine growth deposits, especially black oxides found in depths beyond the soft marine growth zone.

In addition to offshore oil wells, there are many, many other applications for underwater cleaning operations. Ships occasionally require underwater cleaning so as to improve the hydrodynamics of the vessels. Underwater pipelines require cleaning for defect and flaw inspections. Many port facilities have supports extending deeply into the water. These supports are often times are subject to visual inspection for flaws and defects.

Until the present invention, it was thought difficult and expensive to clean these underwater surfaces. In addition, the personnel and equipment were unavailable to carry out these cleaning activities at depths beyond conventional mixed gas diving. As a result, flaw and defect inspection activities were delayed or unable to be carried out effectively.

It is an object of the present invention to provide an optical cleaning system for efficiently and effectively removing marine growths from underwater surfaces.

It is another object of the present invention to provide an optical cleaning system that removes matter from underwater surfaces in a cost and time effective manner.

It is still a further object and advantage of the present invention to provide an optical cleaning system that can be remotely manipulated and utilized without divers.

It is still a further object and advantage of the present invention to provide an optical cleaning system that reduces the need for deep sea diver manpower.

These and other objects and advantages of the present invention will become apparent from a reading of the attached specification and appended claims.

DISCLOSURE OF THE INVENTION

The present invention is an optical cleaning system for removing matter from underwater surfaces. This optical cleaning system comprises a high-energy strobe lamp, a capacitor electrically connected to the strobe lamp for storing energy to be passed to the strobe lamp, a power supply electrically connected to the capacitor such that the power supply charges the capacitor, and a trigger circuit electrically interactive with the capacitor so as to cause the capacitor to pass energy to the strobe lamp. The strobe lamp may be either a xenon lamp for intermittant bursts of photon energy or it may be a krypton lamp for continuous duty. In either case, the strobe lamp should have a capacity to be operated at more than 10 kilojoules of explosion energy. Additionally, the strobe lamp should have a structural integrity capable of withstanding submerged pressures up to 1,500 feet. However, in the future, improved designs of oilfield structures may require greater structural integrity for use at greater depths. The high energy strobe lamp of the present invention may be part of a plurality of such lamps hinged to each other so as to facilitate desired manipulation. A stainless steel reflector is arranged about the strobe lamp such that the reflector reflects light from the strobe lamp to the area to be cleaned on the underwater surface. The capacitor that receives and stores energy should have a capacitance of greater than 500 microfarads. The power supply that passes the energy to the capacitor should be a generator with a capacity of 10 kilovolts or less.

In addition to the above-stated components of the present invention, the optical cleaning system can further comprise a cooling fluid circulation system arranged in heat exchange relationship with the strobe lamp. This cooling fluid circulation system should pass deionized water about the lamp.

The trigger circuit of the present invention can be either an internal or an external trigger. As an external trigger, a transformer is electrically connected in series with the capacitor and with the strobe lamp. This transformer should be capable of producing a sufficient voltage for discharging the capacitor. A switch is provided for activating or deactivating the transformer. Operated externally, the trigger circuit of the present invention comprises an electrical coil encircling the strobe lamp, an electrical supply for causing an ionization effect in the strobe lamp, and switch for passing the electrical supply to the electrical coil.

The present invention also comprises a method for cleaning underwater surfaces. This method comprises the steps of: (1) positioning a high energy strobe lamp adjacent to the area to be cleaned; (2) charging a capacitor that is electrically in line with the strobe lamp; and (3) discharging the capacitor such that the stored energy and the capacitor is passed to the strobe lamp. As a result, the strobe lamp produces a high energy burst of light that is directed to the area to be cleaned. This method may further comprise the step of circulating a cooling fluid in heat exchange relationship about the strobe lamp while this strobe lamp is producing this high energy burst of light. Furthermore, the method of the present invention comprises the step of pressurizing the high energy strobe lamp relative to the pressures of the water depth in which the strobe lamp is positioned.

BEST MODE FOR CARRYING OUT THE INVENTION

Figure 1:
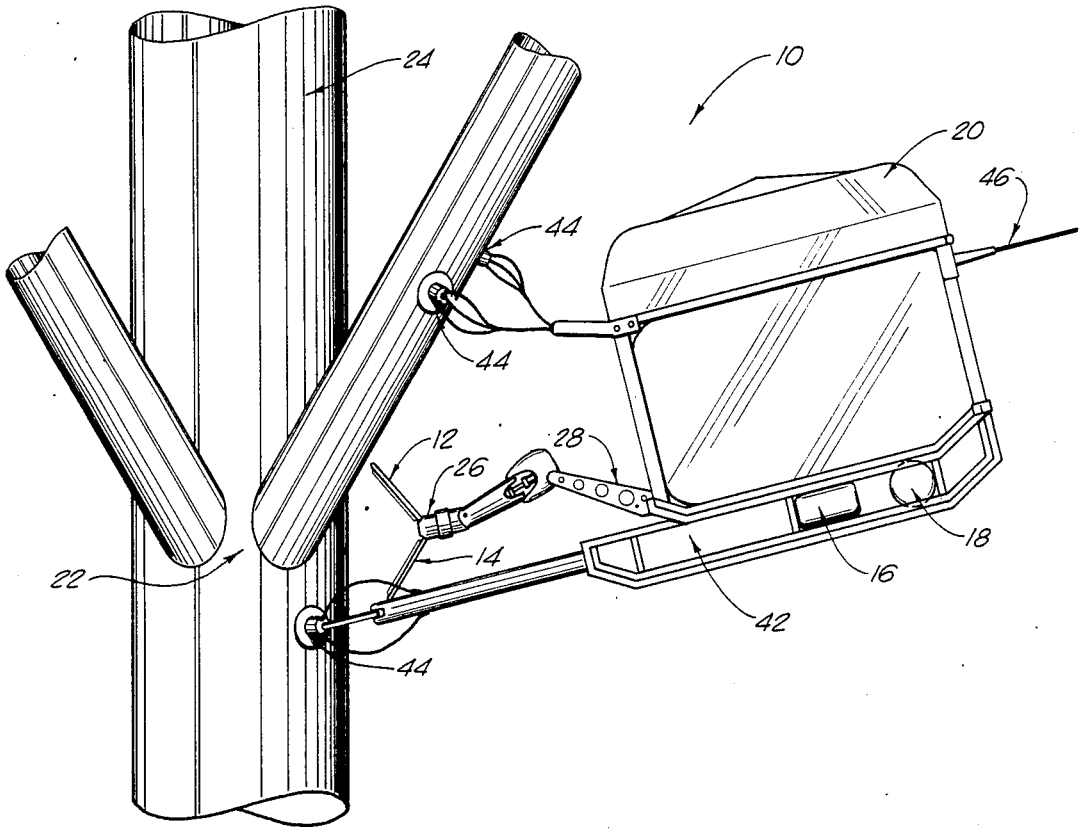
FIG. 1 is a view in side elevation of the optical cleaning system of the present invention.

The optical cleaning system of the present invention is shown at 10 in FIG. 1. The optical cleaning system 10 comprises strobe lamps 12 and 14, high-voltage capacitor pack 16, high-voltage power supply 18, and underwater manipulator 20. In FIG. 1, the optical cleaning system 10 is shown positioned so as to clean weld at the node 22 of oil platform 24.

An essential feature of the present invention is the strobe lamps 12 and 14. In FIG. 1, strobe lamps 12 and 14 are hinged about bracket 26. The arrangement of the strobe lamps 12 and 14 is shown in greater detail in FIGS. 4 and 5. The position of the strobe lamps 12 and 14 is controlled by the manipulation, in various directions, of arm 28. Arm 28 is movably mounted to the manipulator 20. The appropriate manipulations of arm 26 will cause strobe 12 and 14 to be positioned adjacent the area to be cleaned on oil platform 24.

Figure 5:
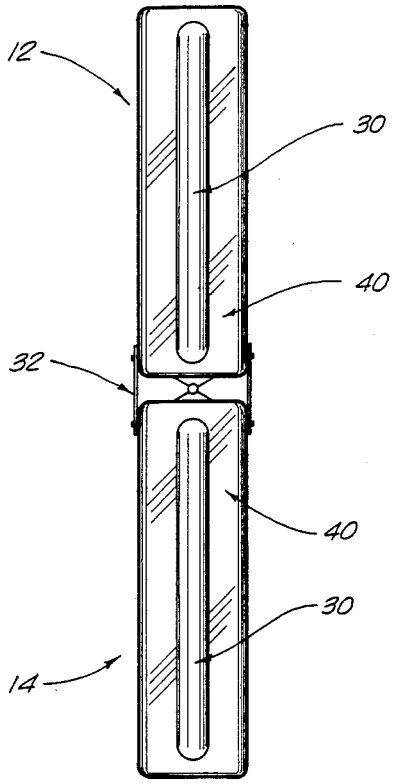
FIG. 5 shows the lamp configuration of FIG. 4 in an open position.

Referring to FIG. 5, strobe lamps 12 and 14 are shown in their "open" position. Strobe lamps 12 and 14 are xenon lamps. These xenon lamps are of the type having the capacity to be operated at between 10 and 25 kilojoules of explosion energy. The xenon lamps are shown at 30 in FIG. 5. These xenon lamps are well suited for high overall optical output and maximum energy output during intermittant duty cycles. Xenon lamps of the type shown and described in the present invention are manufacutured and sold by E G & G, Inc. of Salem, Mass.

It should be noted that the present invention is not limited to xenon lamps. It is also possible to substitute krypton lamps for the xenon lamps within the concept of the present invention. Krypton lamps exert more infrared energy and are better suited for continuous duty. Although the present invention is described as using "strobe lamps", it is possible that these strobe lamps can be set to provide for continuous duty. As a result, the krypton lamps can be used to provide a "burning" type of effect, rather than an explosion effect.

Figure 4:
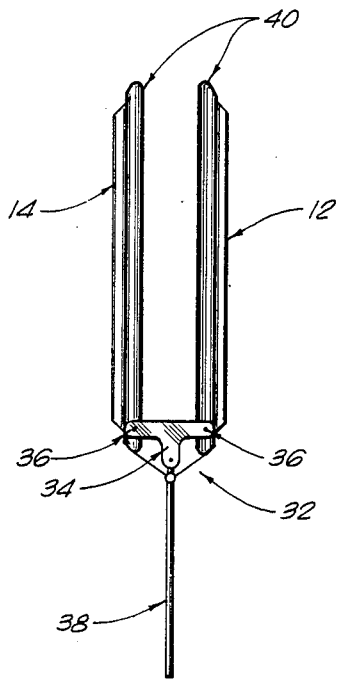
FIG. 4 is a view in side elevation of one embodiment of the lamp configuration of the present invention.

As shown in FIGS. 4 and 5, lamps 12 and 14 are connected by hinge 32. In FIG. 4, hinge 32 comprises a mounting plate 34 with pin connections 36 fastening to strobe lamps 12 and 14. The manipulation, opening, and positioning of the strobe lamps 12 and 14 is facilitated by movements of rod 38.

The xenon lamps 30 are somewhat enclosed by reflectors 40. Alternatively, these reflectors could also be polished quartz reflectors. Reflectors 40 are stainless steel reflectors. Reflectors 40 would, typically, permit a 90° aperture for light emission. The reflectors serve to shield the operator from the burst of energy of the lamps and to concentrate the energy from the lamps onto the surface to be cleaned.

The high-voltage capacitor 16 is electrically connected to the strobe lamps 12 and 14. The capacitor 16 serves to store energy that will be passed to the strobe lamps. The capacitor should have a capacitance of greater than 500 microfarads. The capacitor 16 is conveniently mounted in the sled portion 42 of manipulator 20. The high-voltage power supply 18 is also mounted to sled 42. Both capacitor 16 and power supply 18 should be housed in waterproof containers. Power supply 18 is a 5 kilovolt power supply. Power supply 18 is electrically connected to capacitor 16. Power supply 18 is a generator that is used to charge the capacitor. The power supply 18 must produce a rated voltage and must be capable of withstanding the total energy draw caused by the discharge of capacitor 16.

The manipulator 20 serves as a means for remotely positioning the strobe lamps 12 and 14 adjacent to an underwater surface. The vehicle shown in FIG. 1 is a Hydra 1000 TM remote vehicle manufactured by Oceaneering, Inc. The arm 28 is also a standard component of this type of remote vehicle. The remote manipulator 20 is anchored to the oil platform 24 by anchors 44. The remote manipulator 20 is electrically connected to a remote controller (not shown) by line 46. The remote controller is part of a remote vehicle package and allows the operator of the remote manipulator to control the movements of the manipulator from above the surface of the water.

Figure 2:
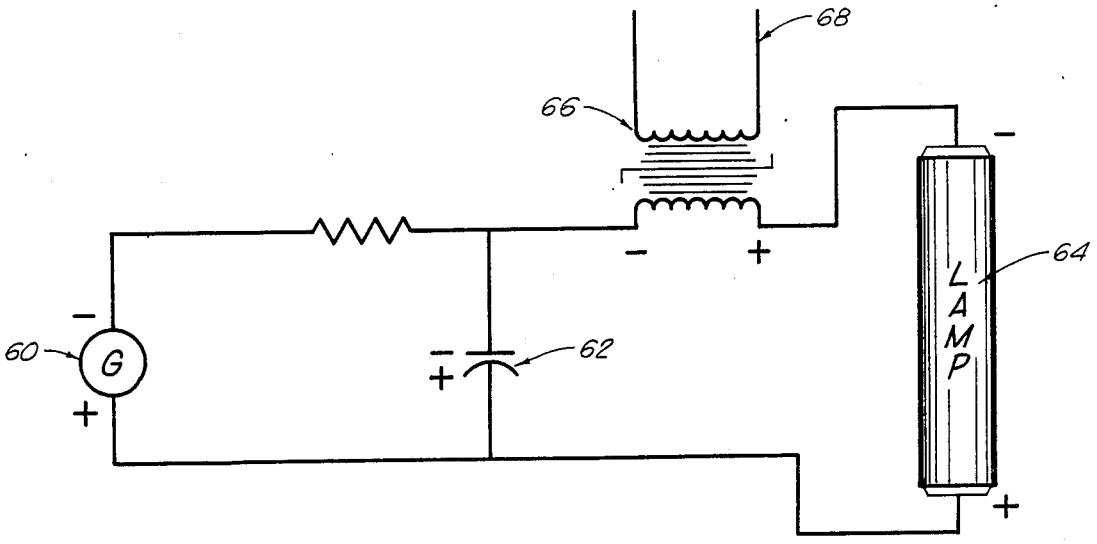
FIG. 2 is a electrical schematic representation of the electronics of the optical cleaning system of the present invention.

FIG. 2 is a simplified electrical schematic showing the electronics of the optical cleaning system. FIG. 2 shows power supply 60 connected to capacitor 62. The power supply 60 charges capacitor 62. Lamp 64 is a xenon or krypton lamp of the type describe herein before. A trigger circuit/transformer 66 is electrically connected in series with lamps 64 and with capacitor 62. The embodiment of the electronics, shown in FIG. 2, utilizes an internal trigger circuit. While FIG. 2 shows a simplified schematic of the electronics of the present invention, in operation, the electronics will be tuned for maximum efficiency for the particular type of strobe lamp 64 that is being utilized.

In operation, the electronics of FIG. 2 permit the charge stored in capacitor 62 to be discharged upon the actuation of trigger circuit 66. Initially, the power supply 60 generates electricity and passes this electricity into capacitor 62 for storage. When the lamp 64 has been manipulated into proper position, the trigger circuit 66 may be actuated by a switch connected to line 68. The switch connected to line 68 is operable in two modes. The first of the two modes is for producing an insignificant voltage through line 68 and, thus, into transformer 66. The other of the two modes is for actuating the transformer for producing a high-voltage, low amperage electrical signal. Once the high voltage pulse is generated by transformer 66, the capacitor 62 will discharge the stored energy and pass the energy to lamp 64. This causes the lamps to produce a high energy burst of light toward the underwater surface to be cleaned.

Figure 3:
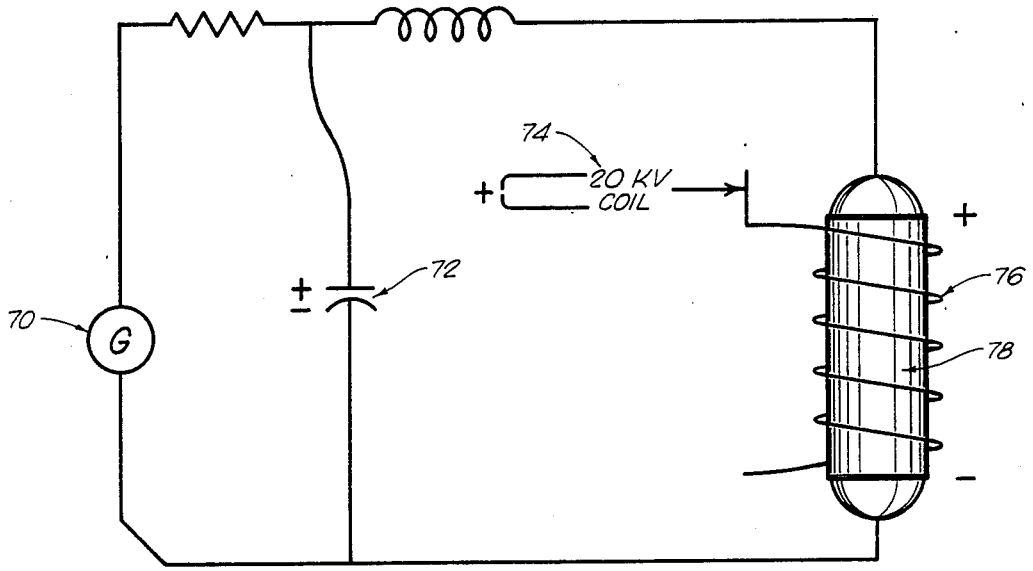
FIG. 3 is an electrical schematic showing an alternative embodiment of the electronics of the present invention.

FIG. 3 shows an alternative embodiment of the electronics of FIG. 2. Specifically, FIG. 3 shows power supply 70, capacitor 72, electrical supply 74, electrical coil 76, and lamp 78. The combination of the electrical supply 74 and electrical coil 76 present an external trigger circuit acting on lamp 78. The passing of the high voltage energy supply from generator 74 into coil 76 will create an ionizing effect within lamp 78. When the lamp 78 begins to ionize, lamp 78 becomes a conductor. This conductance will cause capacitor 72 to discharge and therby pass the stored energy into lamp 78. The lamp 78 will then produce the high energy burst of light. This external trigger circuit allows the trigger circuit to be isolated from the energy circuit. As with the embodiment shown in FIG. 2, this external trigger is also operated by means of an appropriate switch. This switch is interactive with the electrical coil 76 and the electrical supply 74. One mode of the switch causes the electricity to flow from the electrical supply 74 into the coil. The other mode of the switch prohibits this passage of electricity. In this manner, the burst of light energy from lamp 78 can be controlled from a remote location.

Figure 6:
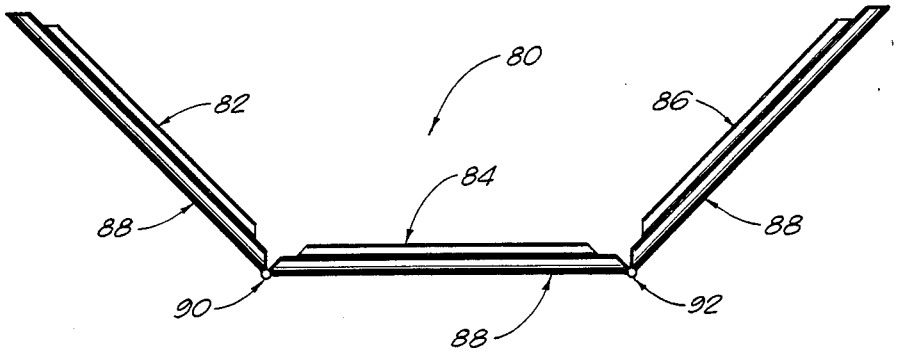
FIG. 6 shows an alternative embodiment of the lamp configuration of the optical cleaning system of the present invention.

FIG. 6 shows an alternative configuration 80 of the strobe lamps of the present invention. Specifically, configuration 80 shows three strobe lamps 82, 84, and 86. Each of these strobe lamps includes reflectors 88 attached thereabout. The strobe lamp 82 is hinged at point 90 to strobe lamp 84. Similarly, strobe lamp 84 is hinged at 92 to strobe light 86. This arrangement of strobe lamps allows the present system to be adaptable to a wide variety of configurations. For example, the angular positioning of each of the lamps of FIG. 6 is quite appropriate for cleaning large areas of tubular surfaces. The arrangement of FIG. 6 also can be manipulated into a planar position so as to make this arrangement more suitable for cleaning flat surfaces.

Figure 7:
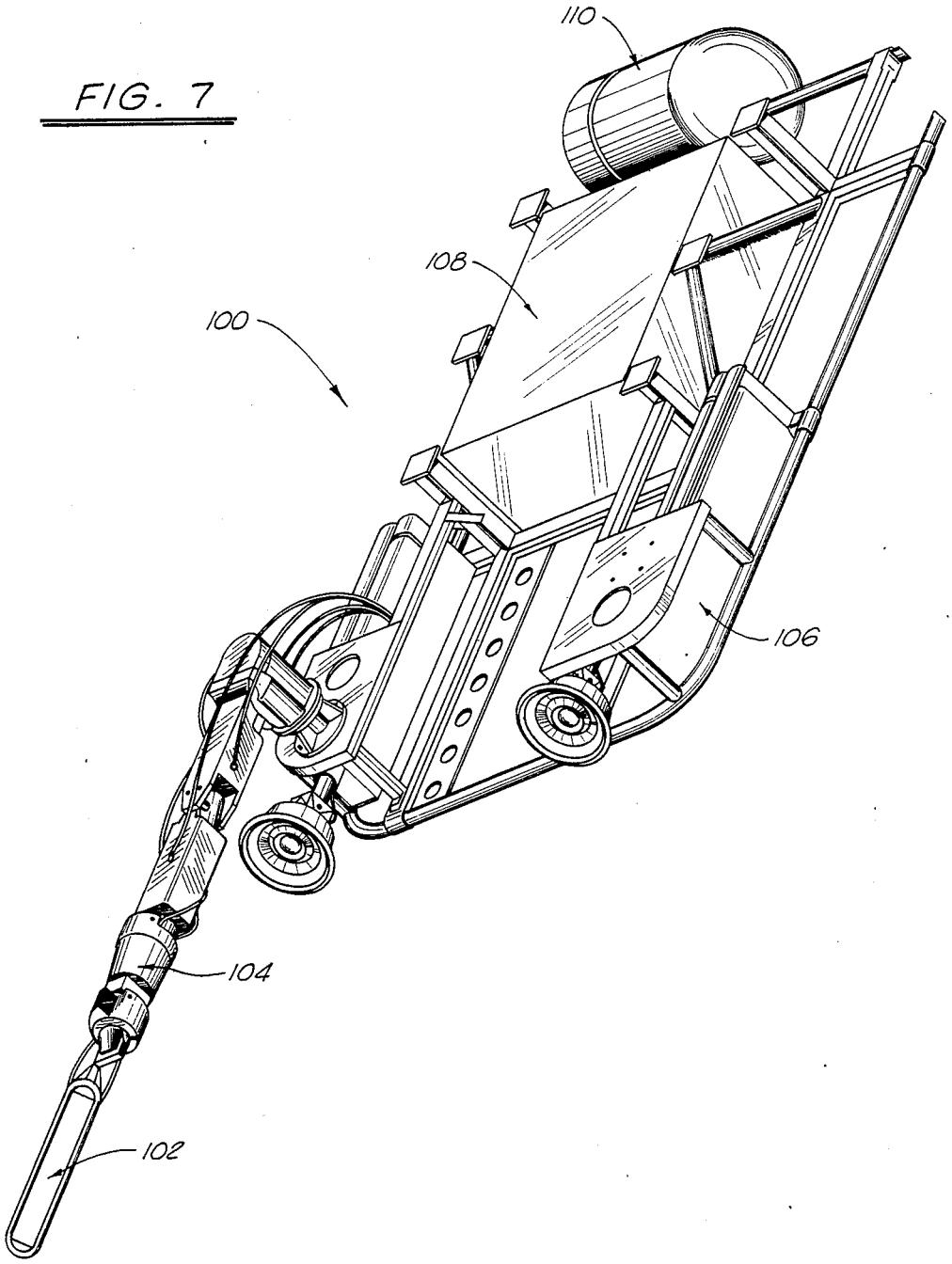
FIG. 7 is a perspective view of an alternative embodiment of the optical cleaning system of the present invention.

FIG. 7 is a perspective view of an alternative arrangement of the optical cleaning system 100 of the present invention. Specifically, optical cleaning system 100 has a single strobe 102, a manipultor arm 104, a remote manipulator frame 106, and an oil-filled container 108 for the high voltage capacitors. The control circuits, electrical power supply, and other high voltage equipment are maintained in drum 110. Container 108 in drum 110 are fastened to the tool sled 106. The sled 106 and manipulator arm 104 is a commercially available manipulator package. The arrangement of the components in relation to the work sled 106 is illustrative of the manner in which the optical cleaning system can be retrofitted to conventional submersibles. Also, the embodiment shown in FIG. 7 illustrates the use of a single strobe lamp 102. This single strobe lamp 102 can be effectively utilized for cleaning surfaces without the need for the extra equipment required for manipulating and positioning multiple-strobe arrangements. The tool sled 106 is manufactured and sold by Perry Hydraulics, Inc.

Figure 8:
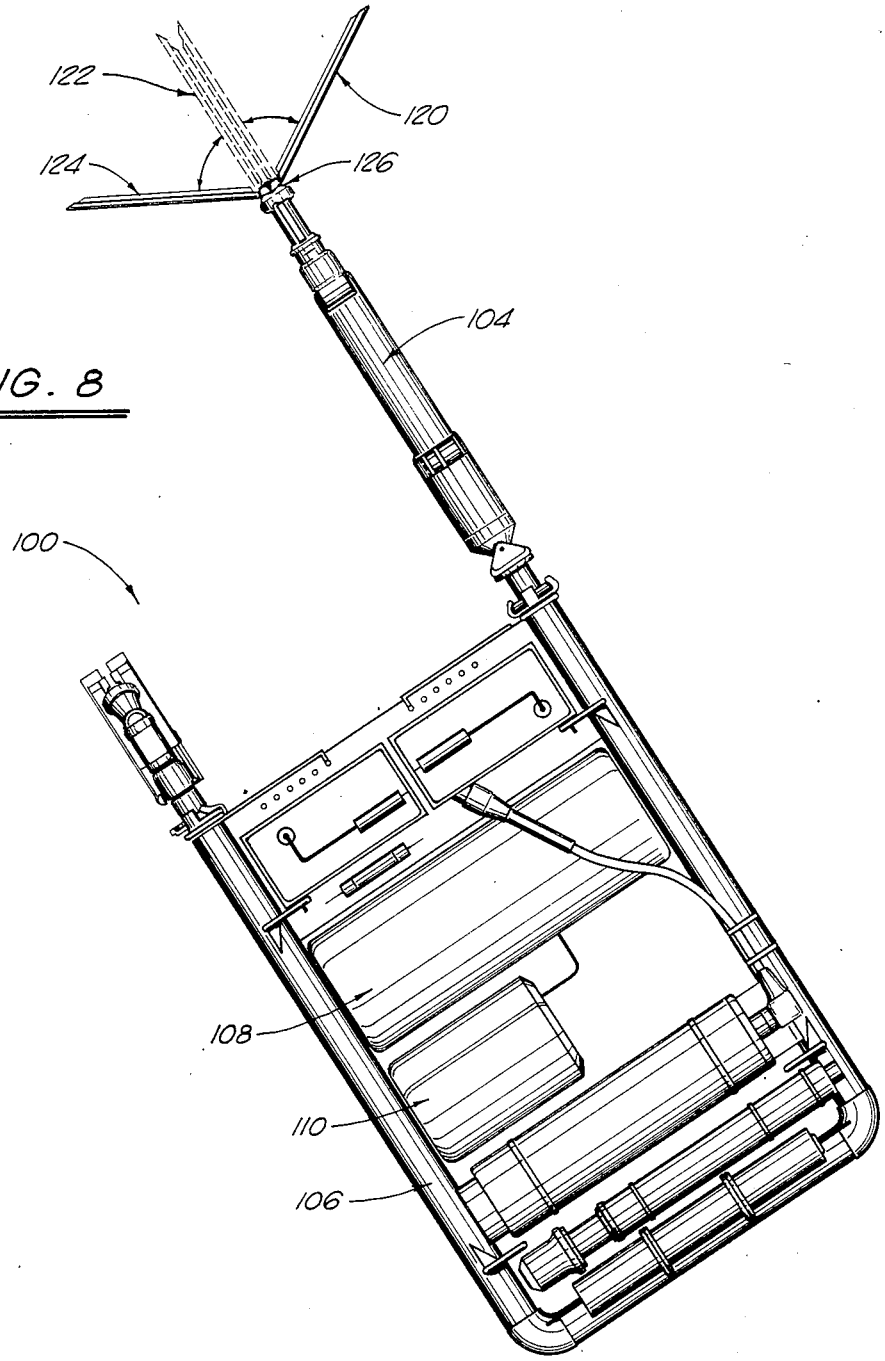
FIG. 8 is a top view of the optical cleaning system of FIG. 7.

FIG. 8 is a top view of an optical cleaning system similar to FIG. 7. This top view shows the oil-filled capacitor bank 108, the high-voltage power supply and control circuit drum 110, as positioned on tool sled 106. FIG. 8 shows the manipulator arm 104 with the multiple-strobe configuration 120. The arrows associated with the FIG. 8 drawing and the strobe configuration 120 show the positions in which the strobe configuration can be manipulated for various purposes. The closed position 122 would be very desirable during the maneuvering phase of the optical cleaning system 100. The strobes 120 would be protected from damage during the manipulating of the sled. The strobes 120 open from the closed position 122 into the open and operating position 124 upon proper manipulation of arm 104 and hinge connections 126. The optical cleaning system of the present invention is in proper condition for cleaning underwater surfaces when the strobes 120 are in the position indicated at 124. When the cleaning operation is completed, the strobes 120 can be returned to their maneuvering position 122.

The present invention offers a highly effective method of cleaning underwater surfaces. The operating of these lamps, at between 10 to 25 kilojoules of explosion energy, should produce sufficient optical power for vaporizing unwanted matter from underwater surfaces. When the explosive burst of light hits a metal that has been incrusted with some material, the incrusted material will expand at a much greater amount and rate than the substructure. In addition, the extraordinary amount of optical power will cause chemical reations in the incrusted material and photochemical disintegration. At the same time, the substrate/metal is not heated excessively because the light power is pulsed. The optical power emitted by the optical cleaning system of the present invention can clean large surfaces areas of concrete, steel, and other anode surfaces. Virtually all marine growth buildups on the surfaces can be effectively loosened and removed by the present invention.

Figure 9:
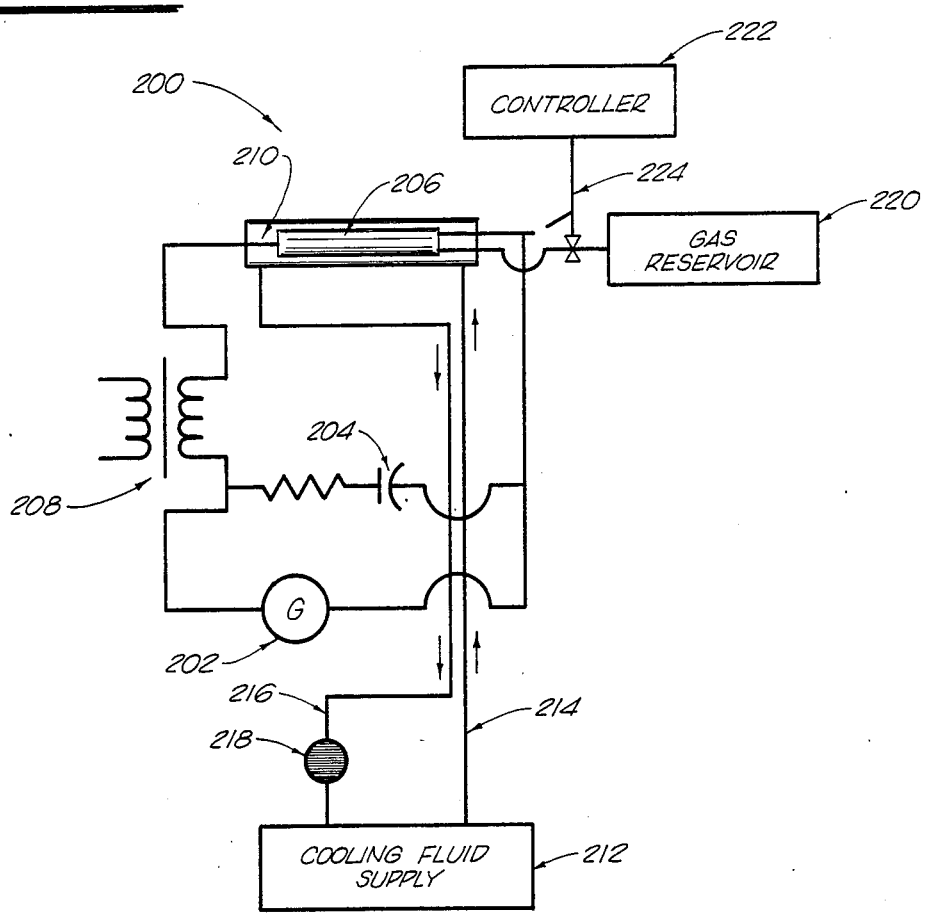
FIG. 9 is a schematical illustration of an alternative embodiment of the electronics of the optical cleaning system of the present invention.

FIG. 9 shows an important alternative approach to the operation and functioning of the present invention. Specifically, FIG. 9 shows the optical cleaning system 200 of the present invention in an embodiment that is suitable for both continuous duty optical cleaning and for use at high depth pressures. The electronics of the optical cleaning system 200 are similar to the previously described electronic configurations. Specifically, a generator 202 provides electrical energy that is transmitted to capacitor 204 for the purpose of charging the capacitor to a desired level. The capacitor is in series with lamp 206. The capacitor 204 is actuated by the appropriate activation of trigger circuit 208. As with the previous embodiments, lamp 206 will produce high bursts of light energy when tigger circuit 208 is activated and capacitor 204 discharges into lamp 206.

The embodiment of FIG. 9 shows the use of a cooling fluid circulation system in combination with lamp 206. Lamp 206 is maintained in a fluid-tight envelope 210. A cooling fluid circulates from the cooling fluid supply 212, through line 214, and into envelope 210. The cooling fluid circulates in envelope 210 heat exchange relationship about lamp 206. Additionally, this cooling fluid circulates about the electrical connections to the lamp 206. This cooling fluid serves to dissipate heat buildup in and about lamp 206. The cooling fluid passes from envelope 210, through line 216, through filter 218, and back into the cooling supply. Suitable pumping equipment (not shown) should be provided so as to provide the circulating ability. The cooling fluid may take a variety of different configurations. It is believed that high purity water, deionized and capable of showing a resistance of 150 kiloohms, would be the preferable cooling fluid. Filter 218 serves to maintain this high purity water in its deionized state.

The cooling fluid circulation system, of the embodiment of FIG. 9, is extremely useful for either the xenon lamps or the krypton lamps. As stated previously, the xenon lamps are best suited for intermittant bursts of optical power. Since these intermittant bursts of optical power produce great amounts of heat, the cooling fluid is very important for maintaining the xenon lamp in proper operating condition.

Where krypton lamps are used in the optical cleaning system, the cooling fluid circulation system is even more important. As stated previously, the krypton lamps are best suited for continuous duty and for producing infrared energy. The continuous duty cycle of these krypton arc lamps is most appropriate for the high-temperature burning of materials from the surface of underwater structures. These krypton lamps produce less of an explosive power, but more of a burning power. The cooling fluid circulation system is very important so as to keep the temperature of the lamp and the envelope 210 to an acceptable and maintainable level.

Also shown on the schematic of FIG. 9 is a gas reservoir and a controller associated therewith. The gas reservoir 220 is in fluid communication with the interior of the xenon or krypton lamp 206. In the case of the xenon lamp, the gas reservoir 220 would contain xenon gas. In the case of the krypton arc lamp 206, the gas reservoir would contain krypton gas. A remote controller 222 is connected by line 224 to a valve associated with the line between the gas reservoir 220 and the lamp 206. This remote controller 222 controls the pressure of the gas within lamp 206.

The gas reservoir 220, in combination with the remote controller 222 and the lamp 206, offers advantages relative to the use and efficiencies of the optical cleaning system of the present invention. Since the optical cleaning system 200 is subjected to submerged pressures, it is important to maintain a pressure balance between the interior of envelope 210 and the pressure external of 210. The gas reservoir is included so as to permit the pressure internal of the envelope 210 to equalize with the pressure external. For example, without this pressure equalization capability, the lamp 206 and envelope 210 could be crushed when exposed to the pressures at 1000 feet of depth. However, by increasing the pressure within the envelope 210 and the lamp 206 so as to generally equal the pressures at such a depth, the potential for crushing could be eliminated.

An additional advantage lies in the efficiency of this arrangement. The capabilities of such strobe lamps are limited in above water use because of the inability of the envelope to withstand the pressures of the gas within the envelope. However, in subsea application, greater containment capability is possible. The natural submerged pressure is acting on the envelope of the lamp would allow a greater amount of xenon or krypton gas to be introduced into the lamp without explosion potential. As a result, the present invention can be used in great depths and have increased optical efficiencies with the inclusion of this gas reservoir and controller. The controller 222 can be remotely situated so as to regulate, monitor, and control the introduction of pressure into the lamp 206. It is believed that this combination would permit the use of the optical cleaning system of the present invention at depths of 350 feet or greater.

The present invention, in each of its embodiments, offer superior capabilities to cleaning systems presently being used in subsea application. The present invention offers a significant cost advantage since the cleaning is achieved quickly over a large surface area. The present invention could also be used to assist and expedite presently existing cleaning techniques.

The foregoing disclosure and description of the invention is illustrative and explanatory thereof, and various changes in the details of the illustrated apparatus, or the details of the described method, may be made within the scope of the appended claims without departing from a true spirit of the invention. The invention should only be limited by the following claims and their legal equivalents.

I claim:

1. An optical cleaning system for removing matter from underwater surfaces comprising:

a high-energy strobe lamp having the capacity to be operated at greater than ten kilojoules of energy, said strobe lamp having a structural integrity capable of withstanding submerged pressures of up to 1500 feet;

capacitance means electrically connected to said strobe lamp for storing energy of greater than ten kilojoules;

a power supply electrically connected to said capacitance means, said power supply for charging said capicitance means; and a trigger circuit means electrically interactive with said capicitance means, said trigger circuit means for causing the instantaneous discharge or greater than ten kilojoules of energy stored in said capacitance means to pass to said strobe lamp.

2. The system of claim 1, said strobe lamp being a xenon lamp.

3. The system of claim 1, said strobe lamp being a krypton lamp.

4. The system of claim 1 said high energy strobe lamp comprising a plurality of strobe lamps hinged to each other.

5. The system of claim 1, said optical cleaning system further comprising:

reflector means arranged about said strobe lamp such that said reflector means reflects light from said lamp to a desired location.

6. The system of claim 5, said reflector means comprising a stainless steel reflector.

7. The system of claim 1, said capacitance means being a capacitor with a capacitance of greater than 500 microfarads.

8. The system of claim 1, said power supply being a generator with a capacity of 10 kilovolts or less.

9. The system of claim 1, said optical cleaning system further comprising:

a cooling fluid; and a cooling fluid circulating means arranged about said strobe lamp for causing a heat exchange effect between said lamp and said cooling fluid.

10. The system of claim 1 said cooling fluid being deionized water.

11. An optical cleaning system for removing matter from underwater surfaces comprising:

a high-energy strobe lamp having the capacity to be operated at greater than ten kilojoules of energy;

capacitance means electrically connected to said strobe lamp for storing energy of greater than ten kilojoules;

a power supply electrically connected to said capacitance means, said power supply for charging said capacitance means; and a trigger circuit means electrically interactive with said capacitance means, said trigger circuit means for causing the instantaneous discharge of greater than ten kilojoules of energy stored in said capacitance means to pass to said strobe lamp, said trigger circuit means comprising:

a transformer means electrically connected in series with said capacitance means and said strobe lamp, said transformer means capable of producing a sufficient voltage for discharging said capacitance means; and switch means electrically connected to said transformer means, said switch means operable in two modes, the first of said two modes for producing insignificant voltage by said transformer means, the other of said two modes for actuating said transformer so as to produce said sufficient voltage for discharging said capacitance means.

12. The system of claim 1, said trigger circuit means comprising;

an electrical coil encircling said strobe lamp;

an electrical supply of sufficient capacity to cause an ionization effect in said strobe lamp, said electrical supply electrically connected to said electrical coil; and electrical switching means interactive with said electrical coil and said electrical supply, said switching means operable in two modes, the first of said two modes for causing said electrical supply to pass to said electrical coil, the other of said two modes for stopping the flow of electricity from said electrical supply to said electrical coil.

13. An optical cleaning system for removing matter from underwater surfaces comprising:

a high-energy strobe lamp having the capacity to be operated at greater than ten kilojoules of energy;

capacitance means electrically connected to said strobe lamp for storing energy of greater than ten kilojoules;

a power supply electrically connected to said capacitance means, said power supply for charging said capacitance means; and a trigger circuit means electrically interactive with said capacitance means, said trigger circuit means for causing the instantaneous discharge of greater than ten kilojoules of energy stored in said capacitance means to pass to said strobe lamp:

underwater manipulation means attached to said strobe lamp for positioning said strobe lamp adjacent the surface from which matter is to be removed; and remote controller means electrically connected to said manipulation means for permitting above-water control of said manipulation means.

14. The system of claim 13, said manipulation means comprising:

a work sled containing said capacitance means and said power supply;

an arm manipulator movably connected to said work sled, said arm being responsive to said remote controller means, said arm having said strobe lamp attached to the end of said arm opposite said work sled.

15. A method of cleaning underwater surfaces comprising the steps of:

positioning a high energy strobe lamp adjacent to the area to be cleaned said step of positioning comprising:

lowering said strobe lamp into a body of water; and manipulating said strobe lamp from a remote location such that said strobe lamp will direct a photon beam towards said area to be cleaned;

charging a capacitor with greater then ten kilojoules or energy said capacitor electrically connected to said strobe lamp; and discharging greater then ten kilojoules of energy from said capacitor such that the stored energy in said capacitor passes to said strobe lamp, said strobe lamp producing a high energy burst of light directed toward said area to be cleaned.

16. The method of claim 15, further comprising the step of:

circulating a cooling fluid in heat exchange relationship about said strobe lamp while said strobe lamp produces said high energy burst of light.

17. The method of claim 15, said step of discharging comprising;

triggering a transformer such that said transformer produces a high voltage of relatively low amperage, said transformer being electrically connected in series with said capacitor and said strobe lamp.

18. The method of claim 15, said step of positioning comprising:

placing said high energy strobe lamp within eighteen inches of the area to be cleaned.

19. A method of cleaning underwater surfaces comprising the steps of:

positioning a high energy strobe lamp adjacent to the area to be cleaned;

pressurizing said high energy strobe lamp in relation to the pressures of the water depths which said strobe lamp is positioned;

charging a capacitor with greater than ten kilojoules of energy, said capacitor electrically connected to said strobe lamp; and discharging greater than ten kilojoules of energy from said capacitor such that the stored energy in said capacitor passes to said strobe lamp, said strobe lamp producing a high energy burst of light directed toward said area to be cleaned.

* * * * *